United States Patent [19]

Cook et al.

[11] 4,178,260

[45] Dec. 11, 1979

[54] ESTER BASED METAL WORKING LUBRICANTS

[75] Inventors: Brian A. Cook, Abingdon; Thomas W. Brown, Didcot, both of England

[73] Assignee: Exxon Research & Engineering Co., Florham Park, N.J.

[21] Appl. No.: 814,857

[22] Filed: Jul. 12, 1977

Related U.S. Application Data

[63] Continuation-in-part of Ser. No. 626,662, Oct. 29, 1975, abandoned.

[30] Foreign Application Priority Data

Oct. 31, 1974 [GB] United Kingdom ..... 47154/74

[51] Int. Cl.[2] ..... C10M 1/10

[52] U.S. Cl. ..... 252/49.8; 72/42; 252/49.5; 252/56 S

[58] Field of Search ..... 252/49.5, 49.8, 56 S

[56] References Cited

U.S. PATENT DOCUMENTS

| | | | |
|---|---|---|---|
| 3,026,262 | 3/1902 | Foster et al. | 252/49.8 |
| 3,236,774 | 2/1966 | Thompson et al. | 252/49.8 X |
| 3,459,663 | 8/1969 | Rue | 252/49.5 X |
| 3,496,104 | 2/1970 | Shimada et al. | 252/49.8 X |
| 3,526,596 | 9/1970 | Kress et al. | 252/49.8 X |
| 3,567,636 | 3/1971 | Katzenstein | 252/49.8 X |
| 3,701,730 | 10/1972 | Daniels et al. | 252/56 S X |
| 3,723,314 | 3/1973 | Davis | 252/49.8 X |
| 3,860,521 | 1/1975 | Aepli et al. | 252/42.1 X |

FOREIGN PATENT DOCUMENTS

| | | | |
|---|---|---|---|
| 904964 | 9/1962 | United Kingdom | 252/56 S |
| 1162317 | 8/1969 | United Kingdom | 252/32.5 |
| 1180389 | 2/1970 | United Kingdom | 252/56 S |
| 1186180 | 4/1970 | United Kingdom | 252/49.8 |
| 1256999 | 12/1971 | United Kingdom | 252/51 SA |
| 1296991 | 11/1972 | United Kingdom | 72/42 |
| 1411654 | 10/1975 | United Kingdom | 252/49.8 |

*Primary Examiner*—Andrew Metz

*Attorney, Agent, or Firm*—Eugene Zagarella, Jr.

[57] ABSTRACT

The invention relates to lubricants for use in metal shaping operations, especially hot and cold rolling of steel and aluminium, and casting of aluminium. Preferred lubricants comprise in a mixture (i) a tetraester of pentaerythritol and a $C_{16}$ to $C_{20}$ aliphatic monocarboxylic acid, (ii) orthophosphoric acid. The lubricants have markedly reduced coefficients of friction; improved roll-wear characteristics and good stability at temperatures of 250+°C. Incorporation of mineral oil and an emulsifier enables the thus modified composition to be used for the preparation of aqueous emulsions or dispersions.

9 Claims, No Drawings

ESTER BASED METAL WORKING LUBRICANTS

CROSS REFERENCE TO RELATED APPLICATIONS

This is a continuation-in-part application of copending U.S. Application Ser. No. 626,662, filed Oct. 29, 1975, now abandoned which is incorporated herein by reference.

BACKGROUND

1. Field of the Invention

This invention relates to lubricants useful in the working of metals, especially the hot rolling and cold rolling of metals, and also in the casting of metals, more especially aluminium. More particularly the invention is concerned with such lubricants which have improved roll anti-wear, and reduced friction properties.

2. Description of the Prior Art

U.S. Pat. No. 3,526,596 discloses a hot-metal working process using a synthetic lubricant consisting only of an ester of a polyol of 2 to 12 hydroxy groups with a $C_{12}$ to $C_{22}$ fatty acid, with no additives. Examples are polyethylene glycol dioleate; tritallowate of trimethylol ethane and tetraoleate of pentaerythritol.

U.S. Pat. No. 3,701,730 discloses synthetic ester basestock lubricants for engine and gear lubrication. The lubricants essentially contain as an extreme pressure additive a dibrominated neopentyl glycol ester. They optionally also contain an alkyl, aryl or alkaryl triester of phosphoric acid. The preferred triester is tricresyl phosphate. The synthetic ester base oils of the lubricants are esters of $C_1$ to $C_{20}$ alcohols, especially $C_4$ to $C_{12}$; and $C_3$ to $C_{20}$ aliphatic carboxylic acids, especially $C_4$ to $C_{12}$. Preferred are polyalcohols such as pentaerythritol, dipentaerythritol and trimethylol propane; and $C_3$ to $C_{12}$ monocarboxylic acids. Lubricants with base oils very similar to the aforesaid preferred types and with additives which include aryl phosphates and various long chain alkyl phosphates are disclosed in U.K. Pat. Nos. 1,180,389; 1,162,317 and 1,256,999.

U.K. Pat. No. 1,186,180 describes lubricant additives which are phosphorous-containing di-, tri-, tetra-, and hexa-carboxylic esters and complex esters. Pentaerythritol esters of $C_4$ to $C_{10}$ monocarboxylic acids are examples of many compounds reacted by heating with esters of a phosphorus-containing acid, to form the additive product.

Finally, in U.K. Pat. No. 904,964, a metal working lubricant is suggested using an ester of a polyhydric alcohol and tall oil, together with an ester of a polyhydric alcohol and fatty acids from animal fats and/or vegetable fats or oil and/or fish oils and/or pure fatty acids, and possibly also together with an additive containing phosphorus, the single example being tricresyl phosphate.

SUMMARY OF THE INVENTION

The invention provides a lubricant comprising a pentaerythritol tetraester derived from a $C_{16}$ to $C_{20}$ aliphatic open-chain carboxylic acid and at least one oil-compatible phosphorus compound selected from phosphoric acids, phosphorous acids and lower alkyl acid phosphates. The lubricant may also contain an emulsifier and a mineral oil to provide a water-emulsifiable lubricant.

By means of the present invention we provide a lubricant having a very low coefficient of friction, the use of which lubricant considerably reduces the wear of the working element compared with other known and suggested lubricants, and which lubricant is capable also of being modified for use in emulsion form in cold rolling techniques.

DESCRIPTION OF SPECIFIC EMBODIMENTS

The lubricant compositions of this invention, which can either be used as such, or form the essential base for a water-emulsifiable lubricant, comprise a mixture of at least one tetraester of pentaerythritol and at least one $C_{16}$ to $C_{20}$ aliphatic monocarboxylic acid and (ii) at least one oil-compatible, phosphorus compound selected from phosphoric acids, phosphorous acids, and alkyl acid phosphates in which the, or each, alkyl radical contains 1 to 4 carbon atoms; said compound or compounds (ii) being present in total amount from 0.01 to 0.5 wt.% (calculated as phosphorus) based on the total weight of (i). Preferably the tetraester employed is liquid at normal temperatures and pressures. By the selection of the said tetraesters and said phosphorus compounds unexpectedly advantageous metal working lubricants are obtained.

Preferably the lower limit of the said range is 0.02 or 0.03 wt.%, more preferably 0.07 wt.% and more preferably 0.1 or 0.2 wt.%. Preferably the upper limit of said range is 0.3 wt.%. One preferred range from the foregoing preferred limits is 0.02 to 0.2 wt.%.

The said aliphatic monocarboxylic acid is preferably an unsaturated acid, most preferably a monethylenically unsaturated acid. $C_{16}$ to $C_{18}$ acids are preferred. Thus, a highly preferred liquid tetraester is pentaerythritol tetraoleate. Such a compound may be derived from a technical or from a substantially pure grade of acid. However, by technical grade is meant one which predominately comprises the acid in question. Thus although, for example, oleic acid is present in tall oil the latter contains a predominating amount of other acids, including phenanthrene ring compounds such as abietic acid. These other acids, e.g. $C_{10}$ and below and more especially the cyclic or closed-chain compounds, have a highly disadvantageous effect. This will be seen in the Example 3 herein, where tall oil compares badly with compositions in accordance with the invention. Similarly the pentaerythritol may be substantially pure or a technical grade containing dipentaerythritol. Example of solid esters are pentaerythritol tetrastearate and pentaerythritol tetrapalmitate.

The phosphorus compound is oil-compatible i.e. soluble dispersible or suspendable in oil, and is preferably liquid at normal temperatures and pressures. The compounds useful in this invention are monoalkyl or dialkyl acid phosphates, each alkyl group containing 1 to 4 carbon atoms; orthophosphoric acid, phosphoric acids, i.e. the known group hypophosphoric acid, pyrophosphoric acid and metaphosphoric acid; and phosphorous acids, i.e. the known group phosphorous acid and hypophosphorous acid. Examples of said alkyl acid phosphates are monomethyl dihydrogen phosphate, dimethyl monohydrogen phosphate, and the corresponding ethyl, propyl, isopropyl, butyl and isobutyl compounds. The methyl and ethyl compounds are preferred.

The quantity of phosphorus-containing compound which is present is such that the amount of phosphorus present is between 0.01% and 0.5% by weight based on the weight of the tetraester. This means that the actual weight of phosphorus compound will be much larger e.g. just over 3 times larger for orthophosphoric acid (atomic weight of phosphorus 31, M.W. of acid 98).

The lubricating oil composition of this invention has been defined in terms of chemical compounds being in a mixture. Their presence together in a mixture may possibly give rise to some chemical reaction. For example at ambient temperature pentaerythritol tetraoleate and orthophosphoric acid may react to a slight extent to give some phosphate esters. The term mixture is therefore employed to include any inter-reacted forms of the said esters and the said phosphorus compounds.

According to features of the invention a lubricant as described above is employed as a lubricant in a process for the hot rolling of steel, or as a mould lubricant in a process of casting a molten metal, especially aluminium.

In hot rolling processes the amount of heating required will of course vary considerably according to the nature of the metal and the form of mechanical working, and typical temperature ranges to which the metal should be heated are given below:

| | Temperature Range °C. | | | |
|---|---|---|---|---|
| Metal | Hot Rolling | Casting | Extrusion | Impact Extrusion |
| Steel | 900°-1400° | 1400°+ | 900°+ | 900°+ |
| Copper | 500°-1000° | | 700°-800° | |
| Brass | 500°-1000° | | 700°-800° | |
| Bronze | 500°+ | | | |
| Stainless Steel | 1000°+ | | | |

After the malleable metal has been heated the lubricant is applied to the surface of the metal, or to a working element. The manner in which the lubricant is applied will vary according to the manner in which the metal is worked. One method suitable for metal billets to be rolled in a rolling mill is to spray the lubricatnt onto the surface of the rolls. One method of doing this, whereupon lubricant is distributed at a substantially uniform rate per unit area onto selected areas of a surface, is that described and claimed in our British patent specification 1,296,991.

In this method the lubricant is projected in a divergent stream towards the surface of the rolls from a nozzle which is mounted for movement towards and away from the surface, the rate of liquid flow through the nozzle being increased with increasing distance between the nozzle and the surface, and decreased with decreasing distance between the nozzle and the surface.

The lubricant can be applied in the liquid state or as a dispersion in water to the metal working elements, such as the working rolls of a hot-steel mill, to produce a uniform continuous film on the surface of the working rolls. Thus, the liquid lubricant can be supplied by means of an atomizer to the upper and lower pressure rolls at the exit side so as to allow the lubricant to be carried into the separation between the pressure and working rolls.

In other forms of metal working similar lubrication methods are employed. Thus, in extrusion either the billet, but preferably the die, is lubricated with the lubricant. In impact extrusion the die and punch are preferably lubricated, although the metal blank or slug could be lubricated.

After the metal surface or the working element has been lubricated, the heated metal is subjected to a working pressure by means of the working element. The working elements are of course the pair of rolls in the case of metal rolling, the die in the case of extrusion, the die and punch in the case of impact extrusion.

After the metal has been subjected to metal working by means of pressure from the working elements one obtains the mechanically worked malleable metal. This may be in its desired final form, or it may be subjected to a further processing state or stages, e.g. annealing, or cold rolling, sheeting, picking, re-working, plating and electroplating.

When a molten metal is cast, the lubricant is applied to the forming element and the metal is cast or formed, and when cool the cast or formed metal is removed from the forming element.

In hot working or casting, traces of lubricant are burnt or evaporated off the hot work pieces and require no special removal.

The invention is particularly applicable to rolling mills used for reducing the thickness of metal billets or strip or for modifying the metallurgical properties of the metal.

In such rolling mills, the metal which is to be processed by the rolling is passed between two opposed work rolls which apply a suitable pressure to the metal to effect the required change to the metal.

The work rolls suffer considerable wear during the metal rolling process, and it has been found that the rate of wear is reduced if a suitable lubricant or wear-resisting coating or film is provided on the work rolls. Apart from the cost of providing replacement work rolls, considerable production losses result during the time required for replacement of the worn work rolls by new work rolls.

The problem of wear of the work rolls is particularly acute in the rolling of hot metal when the metal temperature may be as high as 1300° C., since 20 to 30 minutes are required for worn work roll replacement, and each pair of work rolls can be operative only for 1000 to 1200 tons of metal (in the case of steel strip) before replacement is necessary.

A typical hot-strip metal rolling mill comprises a number of roll stands through which the strip is passed successively. Each roll stand comprises, besides the opposed work rolls between which the metal strip is passed, a pair of back-up rolls which are separated by the pair of work rolls and which apply the rolling force to the work rolls.

Usually, there are six (or thereabout) such roll stands in a rolling mill, and the third stand, or its equivalent, effects the major part of the rolling, and consequently, the work rolls thereof suffer the most wear and damage and need to be changed most frequently. The benefits of the invention arise most particularly in respect of reduced wear in these work rolls, and their back-up rolls, although the invention is also advantageous in respect of work rolls and back-up rolls of other roll stands of the mill.

When the mill is first run with newly installed work rolls, the first strip of the work schedule which is run through the mill is initially relatively narrow strip, and tends to have minor surface defects and misalignments; subsequent strips which are run through the mill are of increased width and have a better finish until, when the work rolls have attained their optimum temperature and surface quality, the widest strip is run through the mill. The widest strip is the most difficult to roll staisfactrily, but at this optimum stage of temperature and surface quality, the best quality strip, suitable for use in automobile manufacture, is obtained. Thereafter, the quality of the finish deteriorates and strips of successively narrower width are run through the mill. The gradual change in width of the rolled strips initially from the narrowest to the widest, and then more gradully to narrower widths has obtained for this programme of rolling the name "coffin schedule". Generally speaking, it is customary to change the work rolls of the third roll stand and sometimes of the second roll stand after about one third of the strips following the widest strip have been rolled (the so-called "intermediate roll change") and to change all the work rolls at the end of the coffin schedule (the so-called "general roll change"). About once each week there is a down time in which all the rolls of the mill, including the back-up rolls, are replaced.

The lubricant should be applied to the surface of each work roll or back up roll. In the initial phase of the coffin schedule the width of the metal strip increases from strip to strip, and the lubricant must be applied over the increased width of each roll which is in contact with the strip. After the widest strip of the coffin schedule has been rolled, the width of the subsequent metal strips decreases, and the width of the work rolls to be coated with lubricant decreases.

During the rolling operation it is desirable that the rate of lubricant distribution per unit area of the work rolls be maintained at critical controlled values. Too much lubricant on the work rolls can result in slipping of the worked metal through the bite of the work rolls with inadequate rolling, and too little lubricant means increased wear.

It is desirable that no lubricant be sprayed onto or applied to the work rolls when metal is first introduced in the bite between rolls. This is to enable a firm grip to be made to the "head" end of the metal and to avoid the possibility of a failure of the work piece to enter the bite.

In accordance with a further feature of the invention a water-emulsifiable lubricant suitable for cold working, especially cold rolling, of metals comprises a lubricating composition as aforedescribed, an emulsifier and mineral oil.

The mineral oil can be a conventional mineral oil such as a petroleum oil fraction ranging from naphthas to spindle oil to SAE 30, 40 or 50 lubricating oil grades. A preferred mineral oil has a viscosity of from 20 to 120 cSt at 100° F. and a VI from 40 to 120, preferably 70 to 105.

Preferred water-emulsifiable lubricants of this invention have, by wt., 5% to 50%, preferably 20–25% tetraester; 45% to 80%, preferably 55 to 60%, mineral oil; 5 to 25%, preferably 12 to 18%, emulsifier and 0.05% to 0.5% by wt. (calculated as phosphorus) of the phosphorus compound (preferably from 0.001 to 0.002 parts said compound per se per part of tetraester, so as to give the required 0.01% to 0.5 wt.% when calculated as phosphorus).

The tetraester is, preferably, pentaerythritol tetraoleate. The phosphorus compound is preferably orthophosphoric acid. The emulsifier can be a conventional emulsifier and is, suitably, selected from sodium petroleum sulphonates and alkylaryl sulphonates. In addition, minor quantities of oleic acid (for example up to 10 wt.%, suitably about 5 wt.%) and an alkanolamine (for example up to 6 wt.%, suitably about 3 wt.%) may optimally, but advantageously be incorporated into the water-emulsifiable lubricants. Triethanolamine is a preferred alkanolamine, although ethamolamine; 2-amino-1-propanol; 3-amino-1-propanol or 2-amino-1-butanol may be employed.

A preferred process for preparing the cold rolling lubricant compositions comprises blending the said ester and the said phosphorus compound (preferably with heating e.g. 60° to 80° C.); blending the oleic (or other said) acid and alkanolamine (again preferably with said heating); combining the two blends and thereafter adding the remaining compounds.

According to further feature the invention provides a process for the hot rolling of aluminum or the cold rolling of steel or aluminum in which there is employed a lubricant prepared from the above described emulsifying agent containing compositions. Suitably the lubricant will be in the form of an aqueous dispersion or emulsion, which may contain up to 99.8 vol.% water, suitably at least 90 or 95 vol.%.

The following examples illustrate aspects of the invention:

EXAMPLE 1

Plant tests were carried out in a hot-strip steel mill using a base lubricant A which was applied to the metal forming rollers. The base lubricant A comprised of pentaerythritol ester of a mixture of predominantly $C_{16-18}$ natural fatty acids.

After several thousands of tons of strip steel heated to about 100° C. had been rolled into sheet form, it was observed that the number of tons of steel rolled per thousandth of an inch measured roll wear of 5.1.

The experiment was then repeated using a composition B having the same base lubricant A but containing also 0.07 wt.% phosphorus as ortho-phosphoric acid. The number of tons of steel rolled per thousandth of an inch roll wear was observed to have increased to 6.6.

EXAMPLE 2

Similar tests to those of Example 1 were carried out at a different hot-strip steel mill using the same base lubricant A above for application to the forming rollers.

After several thousands of tons of strip steel heated to about 100° C. had been rolled into sheet form, visual assessment of the rate of wear of the rollers was as follows:

| Roll Wear Index (Percentage Reduction in Roll Wear) | |
|---|---|
| (a) No lubricant | Standard (0) |
| (b) Base lubricant A | 7 |
| (c) Base lubricant A + 0.04 wt. % phosphorus as ortho-phosphoric acid (Composition A) | 26 |

In both cases these results illustrate the advantage obtained by the use of the two compositions A, B over the base lubricant A alone. In Example 1 an increase of 30% was obtained in the tons rolled per thousandth of an inch roll wear. In Example 2 the percentage reduction in roll wear was almost quadrupled.

EXAMPLE 3

The coefficient of friction was measured on the 8 compositions identified below:

1. A commercially available pentaerythritol tetraoleate.
2. Another commercially available pentaerythritol tetraoleate ($\equiv \overline{A}$)
3. $\overline{A}$ containing 0.07% orthophosphoric acid.

4. $\overline{A}$ containing 0.20% orthophosphoric acid.
5. $\overline{A}$ containing 0.50% orthophosphoric acid.
6. $\overline{A}$ containing 1.00% tricresyl phosphate
7. Tall oil ester of pentaerythritol (≡ $\overline{B}$)
8. $\overline{B}$ containing 0.2% orthophosphoric acid.

The results obtained were as follows:

| Temp. °C. | Coefficient of friction × $10^3$ | | | | | | | |
|---|---|---|---|---|---|---|---|---|
| | 1 | 2 | 3 | 4 | 5 | 6 | 7 | 8 |
| 20 | 124 | 109 | 104 | 99 | 99 | 116 | 118 | 116 |
| 40 | 125 | 112 | 102 | 91 | 97 | 112 | 124 | 110 |
| 60 | 128 | 117 | 104 | 80 | 88 | 109 | 129 | 111 |
| 80 | 131 | 121 | 97 | 70 | 81 | 105 | 133 | 101 |
| 100 | 129 | 104 | 91 | 62 | 72 | 92 | 139 | 102 |
| 120 | 128 | 90 | 80 | 62 | 72 | 84 | 136 | 99 |
| 140 | 131 | 85 | 69 | 57 | 67 | 92 | 128 | 100 |
| 160 | 122 | 86 | 70 | 55 | 54 | 104 | 112 | 106 |
| 180 | 130 | 82 | 65 | 55 | 60 | 98 | 101 | 106 |
| 200 | 133 | 80 | 66 | 57 | 58 | 98 | 116 | 103 |

The above results show the advantage gained from compositions in accordance with the invention (Nos. 3 to 5) when compared with (a) compositions containing only tetraesters alone (Nos. 1, 2 and 7); (b) containing an aryl type of phosphorus compound (No. 6); and (c) tetraesters of a cyclic acid containing mixture with and without a phosphorus compound (Nos. 7 and 8).

Particularly noticeable is (i) the advantage of the use of phosphoric acid over the use of as much as fifteen times the amount of the aryl phosphate compound, and (ii) the necessity to select open-chain aliphatic acids and not cyclic aliphatic acids.

In this example the coefficient of friction was measured by the Soda Pendulum Oiliness Testing Machine; Shinko Engineering Co. Ltd., Japan. This is a commercially available machine, and was employed precisely in accordance with the manufacturer's published instructions.

EXAMPLE 4

The coefficient of friction was measured on the 6 compositions identified below. The measurement was made in the same manner as described in Example 3.

1. A commercially available pentaerythritol tetraoleate (≡ $\overline{C}$)
2. $\overline{C}$ containing 0.2% by wt. of orthophosphoric acid
3. $\overline{C}$ containing 0.2% wt. by wt.% of trilauryl phosphite
4. Pentaerythritol dioleate (≡ $\overline{D}$)
5. $\overline{D}$ containing 0.2% by wt. of orthophosphoric acid
6. $\overline{D}$ containing 0.2% by wt. of trilauryl phosphite.

The results obtained were as follows:

| Temp. °C. | Coefficient of friction × $10^3$ | | | | | |
|---|---|---|---|---|---|---|
| | 1 | 2 | 3 | 4 | 5 | 6 |
| 20 | 129 | 127 | 131 | 130 | 121 | 126 |
| 40 | 126 | 118 | 124 | 131 | 119 | 124 |
| 60 | 123 | 112 | 136 | 130 | 113 | 121 |
| 80 | 117 | 106 | 132 | 126 | 120 | 121 |
| 100 | 108 | 95 | 118 | 126 | 120 | 137 |
| 120 | 113 | 92 | 125 | 147 | 106 | 137 |
| 140 | 131 | 88 | 177 | 147 | 130 | 156 |
| 160 | 157 | 86 | 193 | 186 | 152 | 177 |
| 180 | 174 | 93 | 206 | 184 | 184 | 178 |
| 200 | 189 | 84 | 208 | 188 | 215 | 177 |
| ------ | | | | | | |
| 260 | | 82 | | | | |

The above table shows the marked superiority of composition 2—the one in accordance with this invention. Indeed even at 260° C. composition 2 is stable and gives a remarkably low coefficient of friction. The combination of stability and low coefficient of friction makes the composition attractive not only in metal rolling operations but also in metal casting.

Especially noticeable is the unsuitability of (1) a phosphite (Nos. 3 and 6); and (ii) pentaerythritol dioleate, even with phosphoric acid (Nos. 4 and 5).

EXAMPLE 5

The coefficient of friction was measured on the 4 compositions identified below. The measurement was made in the same manner as described in Example 3.

1. Commercially available pentaerythritol tetraoleate (PETO)
2. PETO plus 0.2 wt.% orthophosphoric acid
3. Pentaerythritol tetracaproate (PETC), (a $C_6$ acid)
4. PETC plus 0.2 wt.% orthophosphoric acid.

The results obtained were as follows:

| Temperature °C. | Coefficient of Friction × $10^3$ | | | |
|---|---|---|---|---|
| | PETO only | PETO + 0.2% $H_3PO_4$ | Pentaerythritol tetracaproate (PETC) | PETC + 0.2% $H_3PO_4$ |
| 20 | 129 | 127 | 161 | 138 |
| 40 | 126 | 118 | 164 | 145 |
| 60 | 123 | 112 | 184 | 147 |
| 80 | 117 | 106 | 181 | 157 |
| 100 | 108 | 95 | 184 | 158 |
| 120 | 113 | 92 | 188 | 163 |
| 140 | 131 | 88 | 190 | 178 |
| 160 | 157 | 86 | 185 | 190 |
| 180 | 174 | 83 | 184 | 205 |
| 200 | 189 | 84 | 185 | 198 |

EXAMPLE 6

The coefficient of friction was measured on the three compositions identified below. The measurement was made in the same manner as described in Example 3.

1. Pentaerythritol tetraoleate (PETO) alone
2. PETO plus 0.2 wt.% butyl acid phosphate
3. PETO plus 0.2 wt.% stearyl acid phosphate, a long alkyl chain acid phosphate.

| Temp. °C. | Coefficient of Friction × $10^3$ | | |
|---|---|---|---|
| | PETO alone | PETO plus 0.2 wt. % butyl acid phosphate | PETO plus 0.2 wt. % Stearyl acid phosphate |
| 20 | 125 | 119 | 121 |
| 40 | 126 | 102 | 127 |
| 60 | 139 | 95 | 126 |
| 80 | 149 | 90 | 132 |
| 100 | 128 | 100 | |
| 120 | 132 | 91 | |
| 140 | 131 | 91 | |
| 160 | 136 | 95 | |
| 180 | 145 | 97 | |
| 200 | 157 | 96 | |
| 220 | 159 | 98 | |
| 240 | 179 | 90 | |
| 260 | 202 | 81 | |
| 280 | 222 | 85 | |
| 300 | 246 | 92 | |

It is not possible to continue measurements with PETO plus the stearyl acid phosphate because a complete solution was difficult to form. Clearly, however, the results which were obtained are far inferior to those obtained by using a composition in accordance with the invention.

Finally, it can be observed in each of Examples 4 to 6 that when employing PETO alone the coefficient of friction has a marked tendency to increase with increase in temperature, whereas the coefficient of friction of the compositions of the invention have a marked tendency to decrease with increase in temperature.

We claim:

1. A lubricating oil composition comprising a mixture of (i) at least one pentaerythritol tetraester of at least one $C_{16}$ to $C_{20}$ aliphatic open-chain monocarboxylic acid, and (ii) at least one oil-compatible phosphorus compound selected from the group consisting of phosphoric acids, phosphorous acids, and alkyl acid phosphates in which the, or each, alkyl radical contains 1 to 4 carbon atoms; said compound or compounds (ii) being present in total amount of from 0.01 to 0.5 wt.% (calculated as phosphorus) based on the total weight of (i).

2. A composition as claimed in claim 1, wherein the said pentaerythritol tetraester is of a $C_{16}$ to $C_{18}$ said acid.

3. A composition as claimed in claim 1, wherein the pentaerythritol tetraester is pentaerythritol tetraoleate.

4. A composition as claimed in claim 1, wherein the said constituent (ii) is selected from phosphoric acids and said alkyl phosphates.

5. A composition as claimed in claim 4, wherein constituent (ii) is orthophosphoric acid.

6. A composition as claimed in claim 1, wherein the said total amount of constituent (ii) present is from 0.02 to 0.2 wt.% (calculated as phosphorus).

7. A water-emulsifiable lubricating oil composition comprising the composition as defined in claim 1, a conventional emulsifier and a conventional mineral oil.

8. A composition as claimed in claim 7, wherein said mineral oil has a viscosity of from 20 to 120 CST at 100° F. and a V.I. of from 40 to 120.

9. A composition as claimed in claim 8, further containing up to 10 wt. % of oleic acid and up to 6 wt. % of an alkanolamine.

* * * * *